US012134444B2

(12) United States Patent
Jenkins

(10) Patent No.: US 12,134,444 B2
(45) Date of Patent: Nov. 5, 2024

(54) CONVERTIBLE BACKPACK KAYAK

(71) Applicant: Avery Jenkins, Cincinnati, OH (US)

(72) Inventor: Avery Jenkins, Cincinnati, OH (US)

( * ) Notice: Subject to any disclaimer, the term of this patent is extended or adjusted under 35 U.S.C. 154(b) by 328 days.

(21) Appl. No.: 17/499,562

(22) Filed: Oct. 12, 2021

(65) Prior Publication Data

US 2022/0111937 A1 Apr. 14, 2022

Related U.S. Application Data

(60) Provisional application No. 63/090,504, filed on Oct. 12, 2020.

(51) Int. Cl.

| | |
|---|---|
| ***B63B 34/23*** | (2020.01) |
| ***A45F 3/15*** | (2006.01) |
| ***B63B 34/26*** | (2020.01) |
| *B63B 29/04* | (2006.01) |

(52) U.S. Cl.

CPC ..... *B63B 34/23* (2020.02); *A45F 3/15* (2013.01); *B63B 34/26* (2020.02); *B63B 2029/043* (2013.01)

(58) Field of Classification Search

CPC ... B63B 34/23; B63B 34/26; B63B 2029/043; A45F 3/15

See application file for complete search history.

(56) References Cited

U.S. PATENT DOCUMENTS 4,478,167 A * 10/1984 Hart ..... B63B 7/04 114/352
5,964,178 A * 10/1999 Gonda ..... B63B 34/23 297/423.46
8,783,204 B1 * 7/2014 Herold ..... B63B 34/23 114/352
9,422,029 B1 * 8/2016 Niemier ..... B63B 34/23
10,442,508 B1 * 10/2019 Hallett ..... B63B 34/23
2004/0011275 A1 * 1/2004 Broom ..... B63B 34/23 114/354
2005/0092227 A1 5/2005 Modi
2006/0254495 A1 * 11/2006 Eckert ..... B63B 34/26 114/347
2008/0121166 A1 * 5/2008 Yaron ..... B63B 34/23 114/347
2009/0165695 A1 * 7/2009 Fritsch ..... B63B 34/23 114/347
2011/0041748 A1 * 2/2011 Morin ..... B63B 32/80 280/414.1
2013/0200115 A1 * 8/2013 Huber ..... B63B 29/04 114/345
2014/0318435 A1 * 10/2014 Murray, III ..... B63H 21/30 114/77 R
2015/0230591 A1 * 8/2015 Maybin ..... A45F 4/10 224/153

(Continued)

*Primary Examiner* — S. Joseph Morano
*Assistant Examiner* — Jovon E Hayes
(74) *Attorney, Agent, or Firm* — Jenei LLC

(57) ABSTRACT

A kayak has a front hull portion and a back hull portion. The front hull portion has a front engagement portion. The back hull portion has a back engagement portion that mates in an assembled state with the front engagement portion to form a passenger cockpit. At least one latch is engageable between the front and the back hull portions in the assembled state. A substantial portion of the rotated front hull portion fits within the back hull portion in a stowed state.

9 Claims, 4 Drawing Sheets

(56) References Cited

U.S. PATENT DOCUMENTS

| | | | | |
|---|---|---|---|---|
| 2016/0316898 | A1 | 11/2016 | Maybin | |
| 2019/0159578 | A1* | 5/2019 | St. Pierre | A45F 3/04 |
| 2021/0309324 | A1* | 10/2021 | Tulli | B63B 29/04 |
| 2023/0115173 | A1* | 4/2023 | Pedigo | B63B 34/23 114/61.27 |

* cited by examiner

CONVERTIBLE BACKPACK KAYAK

CROSS REFERENCE TO RELATED APPLICATION(S)

This patent application claims the benefit and priority of U.S. Provisional Application Ser. No. 63/090,504 entitled "CONVERTIBLE BACKPACK KAYAK" filed Oct. 12, 2020, the disclosure of which is incorporated by reference herein in its entirety as part of the present application.

FIELD OF THE INVENTION

The present disclosure generally relates to watercraft, and more particularly to portable kayak watercraft.

BACKGROUND OF THE INVENTION

A kayak is a small, narrow watercraft which is typically propelled by means of a double-bladed paddle. Kayaks are generally small enough to be mounted on passenger vehicles and then hand carried from the vehicle to rivers and lakes. Some kayaks have attempted to provide additional features enabling one person to carry the kayak. These features have included in certain instances the ability to disassemble the kayak into shorter sections for carrying and reassembling for use. While partially satisfying the need for single person carry, the generally known kayaks are still awkward to carry and inconvenient to configure.

SUMMARY OF THE INVENTION

In one aspect, the present disclosure provides a kayak that has a front hull portion and a back hull portion. The front hull portion has a front engagement portion. The back hull portion has a back engagement portion that mates in an assembled state with the front engagement portion to form a passenger cockpit. At least one cockpit latch is engageable between the front and the back hull portions in the assembled state. A substantial portion of the front hull fits within the back hull portion in a stowed state.

In another aspect, the present disclosure provides a method that includes unlatching one or more cockpit latches that retain a front engagement portion of a front hull portion of a two-piece kayak in watertight engagement with a back engagement portion of a back hull portion of the two-piece kayak. The method includes separating the front and the back hull portion to a disassembled state. The method includes rotating the front hull portion. The method includes inserting the front hull portion substantially into the back hull portion. The method includes attaching a stow latch between the front and the back hull portions to maintain the two-piece kayak in a stowed state. The method includes attaching backpack straps to left and right backpack strap fixtures on a bottom surface of the back hull portion that has a centrally aligned head recess facilitating carrying of the two-piece kayak.

These and other features are explained more fully in the embodiments illustrated below. It should be understood that in general the features of one embodiment also may be used in combination with features of another embodiment and that the embodiments are not intended to limit the scope of the invention.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION

Figure 1:
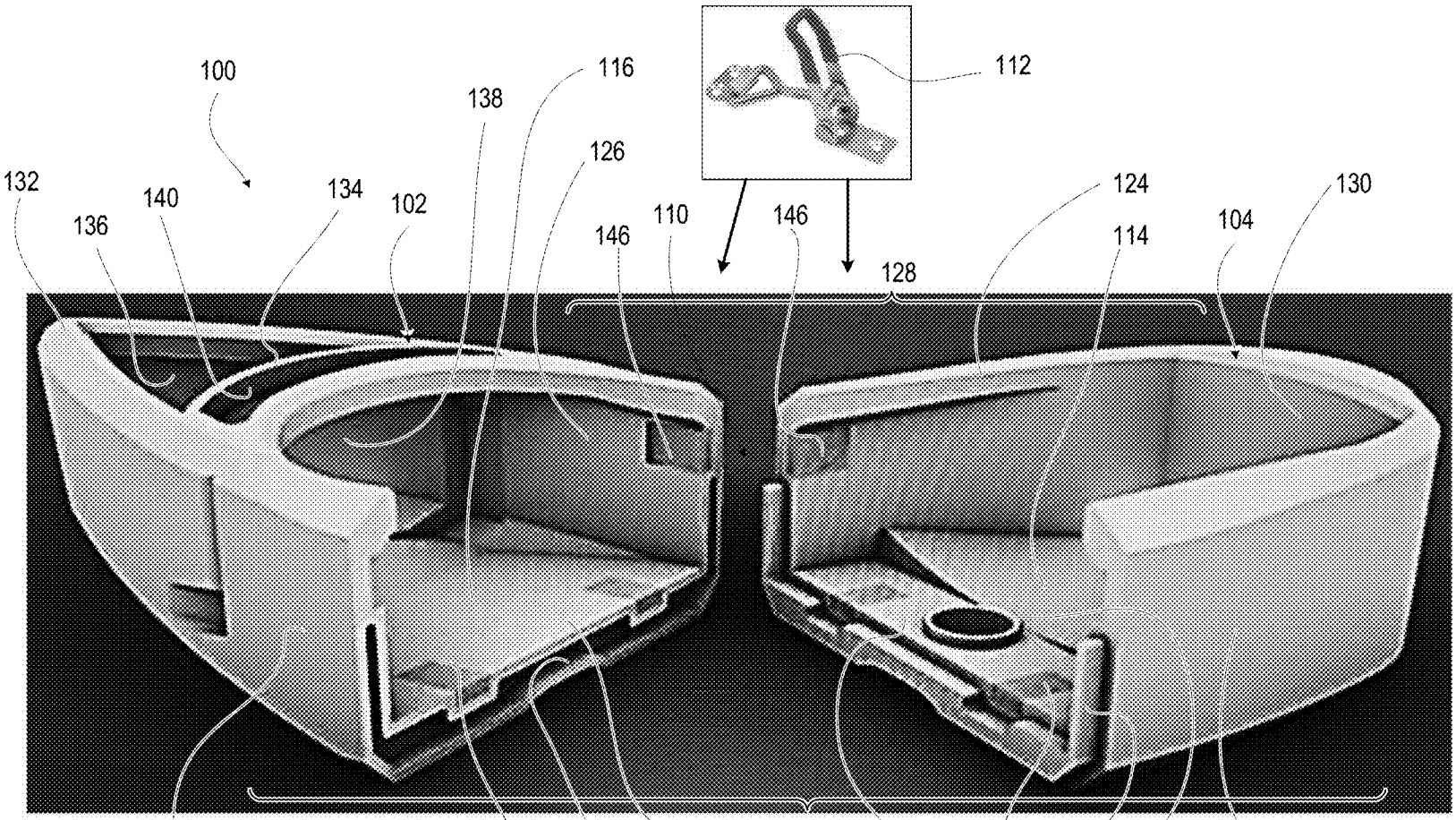
FIG. 1 illustrates a perspective view of a kayak that is separated into front and back halves with a detail view of a latch, according to one or more embodiments.

FIG. 1 illustrates a perspective view of a kayak 100 that is separated into front and back hull portions for ease of transport. In an example embodiment, the front and back hull portions are approximately equal in longitudinal length as front and back hull halves 102, 104. A substantial portion of the rotated front hull half 102 fits within the back hull half 104 in a stowed state. The front and back halves 102, 104 respectively include front and back engagement portions 106, 108 that mate together to form a passenger cockpit 110. At least one cockpit latch 112 is engageable between the front and the back hull halves 102, 104 across the mated front and back engagement portions 106, 108 to maintain the kayak 100 in an assembled state. In one or more embodiments, the cockpit latch(es) 112 are adjustable toggle latch clamps.

In one or more embodiments, the passenger cockpit 110 includes a back floor portion 114 of the back hull half 104 upon which the passenger sits. A front floor portion 116 of the front hull half 102 supports the legs of the passenger. One of the back and front floor portions 114, 116 can include a centrally positioned, dual size cup holder 117 that is positioned to be between the upper legs of the passenger. A back left wall portion 118 of the back hull half 104 and a front left wall portion 120 of the front hull half 102 assemble to define a left side 122 of the passenger cockpit 110. A back right wall portion 124 of the back hull half 104 and a front right wall portion 126 of the front hull half 102 assemble to define a right side 128 of the passenger cockpit 110. The back hull half 104 has an inclined seat back shaped rear wall 130. The front hull half 102 has a pointed bow 132 to the front. A lateral divider 134 of the front hull half 104 defines a pet and storage space 136 with the pointed bow 132 and defines a front wall 138 of the passenger cockpit 110. The lateral divider 134 can include an upwardly open pocket 140 for holding personal items.

In one or more embodiments, one of the front and the back hull portions comprises a channel across left, bottom and rights sides and another one of the front and the back hull portions comprises a protrusion sized to fit within the channel. One of the channel and the protrusion can include a resilient seal to form a watertight seal between the front and the back hull portions. In the depicted embodiment, the front engagement portion 106 includes a rearward presented U-shaped channel 142 across the front left wall portion 118, the front floor portion 116, and the front right wall portion 126. The back engagement portion 108 includes a forward presented U-shaped protrusion 144 shaped for close longitudinal insertion into the U-shaped channel 142. The U-shaped protrusion 144 is across the front left wall portion 120, the front floor portion 116, and the front right wall portion 126. Wood mounting inserts 146 in an otherwise fiberglass constructed kayak 100 facilitate installation and replacement of cockpit latches 112.

Figure 2:
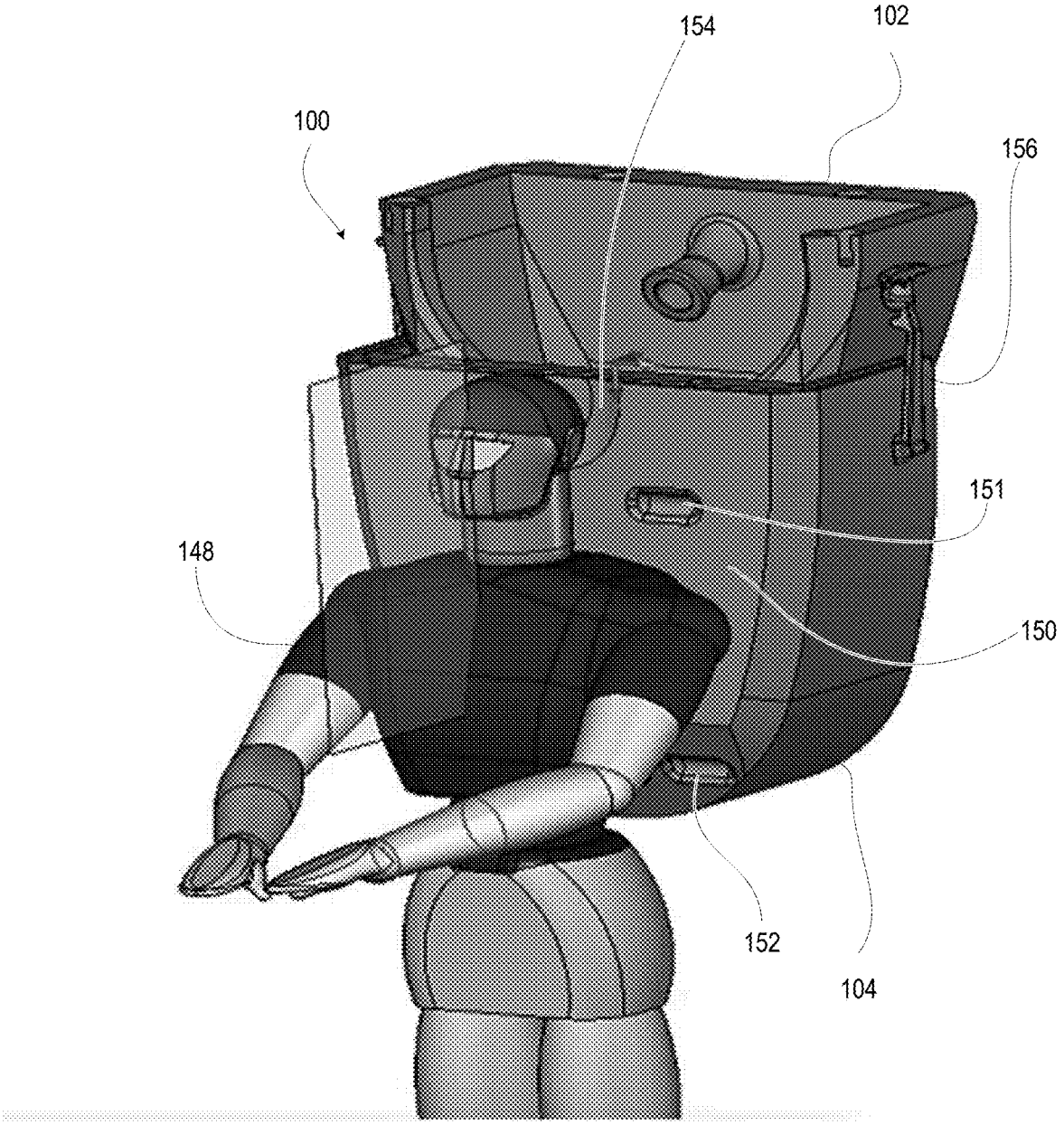
FIG. 2 illustrates a three-dimensional view of the kayak of FIG. 1 in a stowed state and positioned for backpack-style carrying, according to one or more embodiments.

FIG. 2 illustrates a three-dimensional view of the kayak 100 in a stowed state and positioned for backpack-style carrying by a person 148. A bottom surface 150 of the back hull portion comprises upper and lower left and right backpack strap fixtures 151-152 to which a respective shoulder strap (not shown) are attached respectively and a centrally aligned head recess 154. Left and right stow latches 156 are attachable between an exposed portion of the front hull half 102 and the back hull half 104 with the front hull half 102 in the stowed state. In one or more embodiments, components described above are laterally symmetric.

Figure 3A:
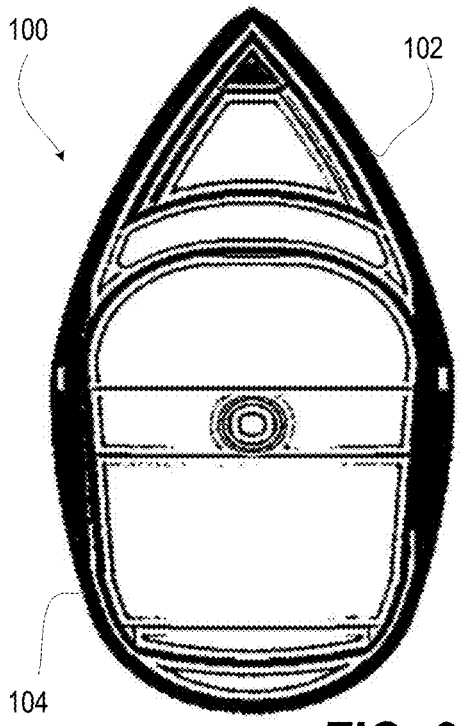
FIG. 3A illustrates a top view of the kayak of FIG. 1 in an assembled state, according to one or more embodiments.
Figure 3B:
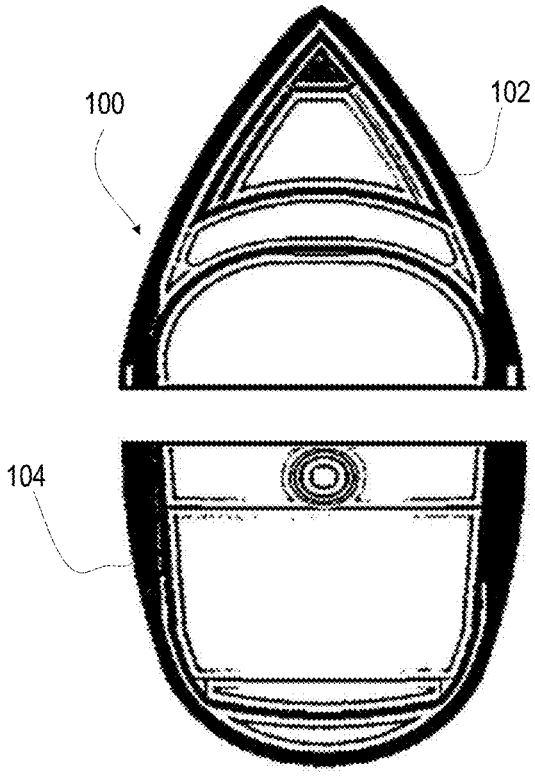
FIG. 3B illustrates a top view of the kayak of FIG. 3A in an unlatched and separated state, according to one or more embodiments.
Figure 3C:
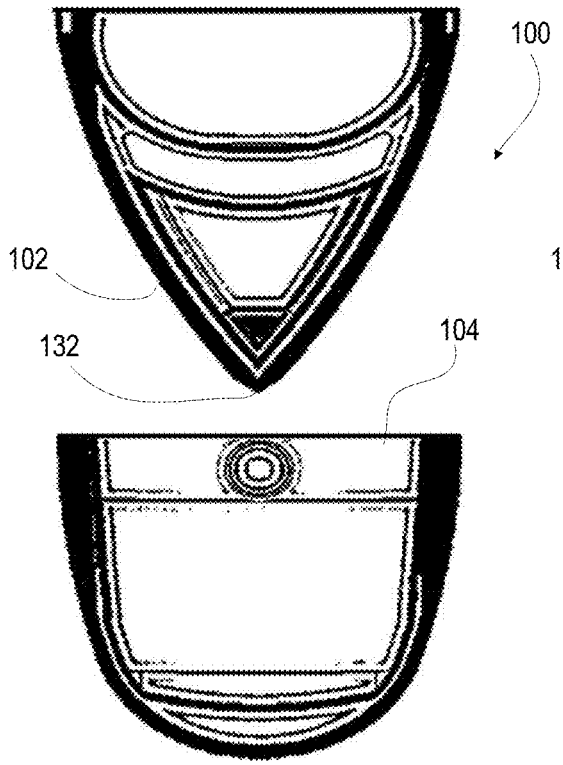
FIG. 3C illustrates a top view of the kayak of FIG. 3B in a rotated state, according to one or more embodiments.
Figure 3D:
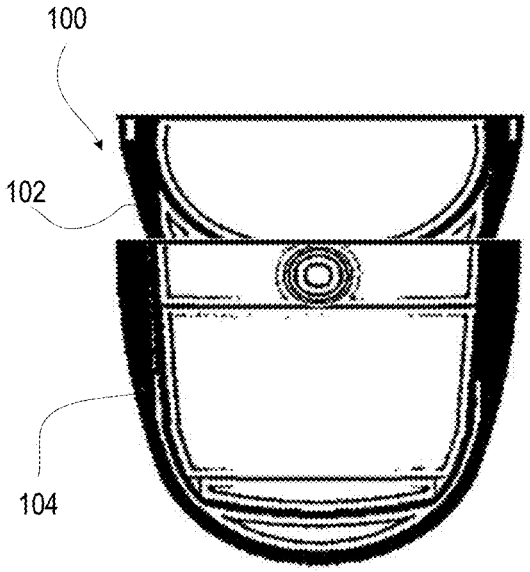
FIG. 3D illustrates a top view of the kayak of FIG. 3C in a stowed state, according to one or more embodiments.

FIG. 3A illustrates a top view of the kayak 100 in an assembled state. The front hull half 102 is mated to the back hull half 104. FIG. 3B illustrates a top view of the kayak 100 in an unlatched and separated state. FIG. 3C illustrates a top view of the kayak 100 with the front hull half 102 rotated 180° prior to insertion of the pointed bow 132 into the back hull half 104. FIG. 3D illustrates a top view of the kayak 100 with the front hull half 102 stowed within the back hull half 104.

Figure 4:
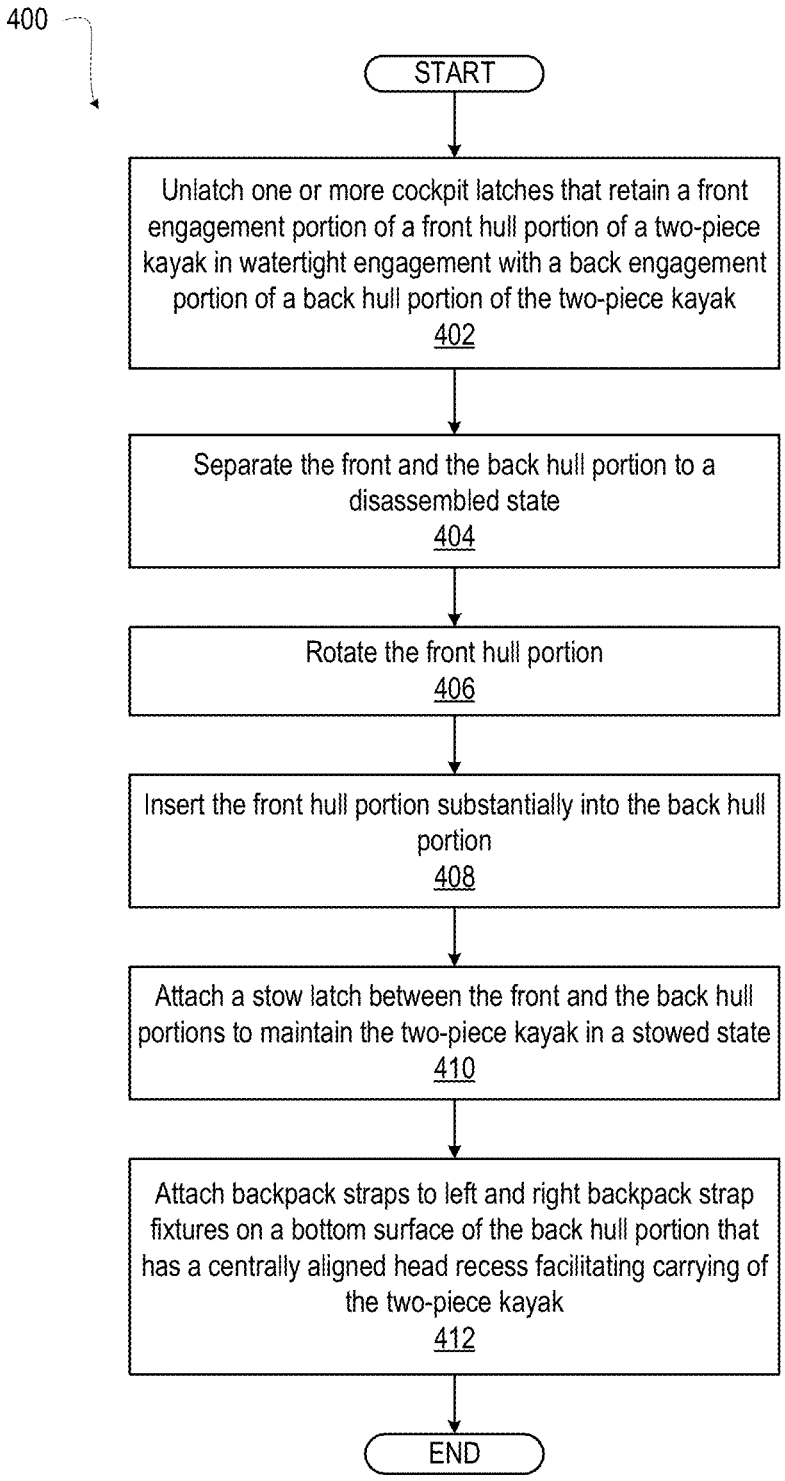
FIG. 4 presents a flow diagram of a method of transporting a two-piece kayak, according to one or more embodiments.

FIG. 4 presents a flow diagram of a method 400 for transporting a two-piece kayak. Method 400 includes unlatching one or more cockpit latches that retain a front engagement portion of a front hull portion of a two-piece kayak in watertight engagement with a back engagement portion of a back hull portion of the two-piece kayak (block 402). The method 400 includes separating the front and the back hull portion to a disassembled state (block 404). The method 400 includes rotating the front hull portion (block 406). The method 400 includes inserting the front hull portion substantially into the back hull portion (block 408). The method includes attaching a stow latch between the front and the back hull portions to maintain the two-piece kayak in a stowed state (block 410). The method 400 includes attaching backpack straps to left and right backpack strap fixtures on a bottom surface of the back hull portion that has a centrally aligned head recess facilitating carrying of the two-piece kayak (block 412). Then method 400 ends.

According to the invention, a plastic molded, sit-on-top kayak is provided having multi-purpose usage, the kayak including removable components which are readily installed and removable, and enable a user to engage in various activities without compromising safety, while still providing the basic activity of paddling. Basically, various versions of the kayak may be derived from a modular configuration which incorporates attachment points for connection with different components to suit individual requirements, and these are more particularly described, infra. The kayak configuration may be sold with all the components as a complete package, or the kayak may be sold with only a few components for a specific market.

In one or more embodiments, the kayak of the present invention may be formed by blow molding, injection, roto molding, thermoforming, and possibly by forming by the more expensive resin or fiber glass lay-up techniques. A shell can be produced by these techniques, thereby improving buoyancy. Suitable plastic resins of construction include polyethylene, PVC, ABS, polypropylene, polyester, and impregnated fibers such as fiberglass.

The bottom surface of the kayak of this invention defines a predominantly flat bottom having multiple channels to better provide tracking when paddling compared to most kayaks having a rounded bottom. Moreover, the flat bottom configuration of the kayak affords greater stability. During portability and during carrying by a single person it rests close to a user's body. In one or more embodiments, ease of portability is facilitated using a molded handle or by use of commercially available strap harnesses.

In one or more embodiments, drain holes are molded through the body of the kayak enable the evacuation of any water that splashes inside the kayak during operation, thereby preventing water from collecting inside the kayak. In one or more embodiments, drain holes are situated inside the seat and cockpit areas and drain water away from the operator and towards the floor scupper drain holes. A drain hole may also be provided in a rear storage area for removing water and melted ice water when used as a cooler.

In one or more embodiments, the kayak further comprises a removable back rest that is ergonomically designed to support a significant portion of a user's back and is formed into a smooth curvature of the seat area. In one or more embodiments, the back rest is easily removed and locks securely in place when being used. Present day kayaks incorporate a low profile, molded-in back rest that does not provide adequate support. This type of back rest is desired by manufacturers to accommodate better shipping rates due to size constraints.

Additionally, with the back rest removed, the kayak is stackable, and easy to package in a low-profile box and easy to store leaning against each other in an upright configuration against any vertical surface. Hence, in addition to being better suited for shipping, the present configuration is useful for display in showrooms. Also, when the back rest is removed, a user will be enabled to more easily strap on additional gear.

In one or more embodiments, an overall length of about 7 to about 9 feet is provided. In one or more embodiments, the rear portion of the boat may be used to attach a rudder to horizontal fins with through holes to also allow attachment of an additional rope carrying handle, or the rear portion may be utilized as the mounting platform for an electric motorized kayak propulsion unit.

The same methods and materials may be applied to other portable, convertible watercraft such as canoes, rowboats, dinghies, sailboats and the like.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

While it is apparent that the illustrative embodiments of the invention herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present invention.

What is claimed is:

1. A kayak comprising:

a front hull portion having a front engagement portion;

a back hull portion having a back engagement portion that mates in an assembled state with the front engagement portion to form a passenger cockpit, wherein a bottom surface of the back hull portion comprises left and right backpack strap fixtures and a centrally aligned head recess;

at least one cockpit latch engageable between the front and the back hull portions in the assembled state, wherein a substantial portion of the rotated front hull portion fits within the back hull portion in a stowed state.

2. The kayak of claim 1, wherein of the back hull portion comprises an inclined seat back shaped rear wall.

3. The kayak of claim 1, wherein one of the front and the back hull portions comprises a channel across left, bottom and rights sides and another one of the front and the back hull portions comprises a protrusion sized to fit within the channel.

4. The kayak of claim 3, where one of the channel and the protrusion comprises a resilient seal to form a watertight seal between the front and the back hull portions.

5. The kayak of claim 1, wherein the front hull portion comprises a lateral divider that defines a pet and storage space in front of the passenger cockpit.

6. The kayak of claim 5, wherein the lateral divider comprises an upwardly open pocket to hold personal items.

7. The kayak of claim 1, wherein one of the front and the back hull portions comprise a centrally positioned cup holder.

8. The kayak of claim 1, further comprising a stow latch attachable between an exposed portion of the front hull portion and the back hull portion with the front hull portion in the stowed state.

9. A method comprising:

unlatching one or more cockpit latches that retain a front engagement portion of a front hull portion of a two-piece kayak in watertight engagement with a back engagement portion of a back hull portion of the two-piece kayak;

separating the front and the back hull portion to a disassembled state;

rotating the front hull portion;

inserting the front hull portion substantially into the back hull portion;

attaching a stow latch between the front and the back hull portions to maintain the two-piece kayak in a stowed state; and attaching backpack straps to left and right backpack strap fixtures on a bottom surface of the back hull portion that has a centrally aligned head recess facilitating carrying of the two-piece kayak.

* * * * *